United States Patent [19]

Keith

[11] Patent Number: 4,754,619

[45] Date of Patent: Jul. 5, 1988

[54] HEAT-SET CHAMBER REDESIGN FOR UNIFORM HEAT SETTING OF CARPET YARNS

[75] Inventor: Kenneth H. Keith, Milledgeville, Ga.

[73] Assignee: West Point-Pepperell, Inc., West Point, Ga.

[21] Appl. No.: 908,462

[22] Filed: Sep. 17, 1986

[51] Int. Cl.[4] ..... D06B 5/06

[52] U.S. Cl. ..... 68/5 E; 28/281

[58] Field of Search ..... 68/5 D, 5 E, DIG. 1; 28/281

[56] References Cited

U.S. PATENT DOCUMENTS

| | | | |
|---|---|---|---|
| 2,317,448 | 4/1943 | Dreyfus et al. | 68/5 E |
| 3,762,187 | 10/1973 | Fleissner et al. | 68/5 E |
| 3,770,374 | 11/1973 | Fleissner et al. | 8/149.3 |
| 3,949,577 | 4/1976 | Fleissner et al. | 68/5 D |

FOREIGN PATENT DOCUMENTS

| | | | |
|---|---|---|---|
| 2478150 | 9/1981 | France | 68/5 E |

OTHER PUBLICATIONS

America's Textiles International Dyeing/Finishing Article "Improving Quality, Efficiency in Continuous Carpet Dyeing" Sep. 1986 (3 pages).

Jul./Aug. 1986 Textile Marketing & Technology Article "BCF: A Versatile Carpet Yarn" (3 pages).

*Primary Examiner*—Philip R. Coe

*Attorney, Agent, or Firm*—James F. Bryan

[57] ABSTRACT

In conjunction with a heat-set apparatus for carpet yarns which incorporates a plenum chamber having a porous upper surface in combination with a forced draft system for recirculating the heating medium throughout the length of the heat-set chamber, an improved design of the plenum chamber and the distribution of the medium to compensate for a temperature gradient which has heretofore existed in the heat-set chamber resulting from the introduction of cooled yarn into the chamber. Such temperature gradient has been the cause of dye streaking which occurs when the yarn is subjected to relatively cooler temperature adjacent to the entrance to the heat-set chamber when the machine is stopped.

3 Claims, 4 Drawing Sheets

HEAT-SET CHAMBER REDESIGN FOR UNIFORM HEAT SETTING OF CARPET YARNS

BACKGROUND OF INVENTION

Prior to the advent of low wet pickup dyeing systems for carpet yarns, variations in heat-setting of such yarns have not presented serious problems. Traditional carpet dye systems heretofor produced good level dyeing notwithstanding slight heat set variations. However, traditional parameters such as good wet out, excessive dye/-fiber liquor ratios and dwell time for dye strike completion are expensive and are under pressure to be modified for economic reasons. Low wet pickup has become increasingly important due to the energy cost of removing excess water from the dyed carpet. The lower the wet out the less energy require to dry the carpet. Low dye liquor ratios have become necessary due to the increasing cost of dye and the expense of removing residuals from waste water before the waste is accepted by city waste water systems. Traditional prior dyeing systems require time and considerable energy, but they do provide excellent quality carpet dyeing. Machine time of expensive new dye systems such as those using the curved blade applicator system and other systems constantly pressure dye houses to raise their speeds for higher production.

As continuous dye systems are modified for low wet pickup and speeds are increased for more production, strike rate becomes a very critical factor in the level dyeing of carpet. In the past, inherent designs of heat set machines have created strike rate variations which nevertheless produced satisfactory results because these were accompanied by excessive dye liquor ratios and time. These strike rate differences have gone unnoticed until the advent of the new dye systems. Strike rate variations result in variable dye uptake at high speeds which produces light dyeing intermittent areas within the end of yarn.

The present invention concerns an improvement to the construction and operation of continuous autoclave heat setting machines which include a heat recirculation system. Such machines have been in long continuous use to heat set yarn for carpets. The design includes a sealed tubular heat-set chamber approximately 16 feet long through which is driven a conveyer belt upon whose upper surface rests the yarn which is to be heat set. Steam is generated in the heat-set chamber and totally encompasses the conveyer belt and yarn thereon, the temperature of the chamber being maintained to the required heat set temperature which may be for example 270 degrees Fahrenheit. A forced continuous recirculation system takes the heating medium from a point adjacent to the exit of the heat-set chamber and returns such medium to a point adjacent to the entrance of such chamber from which it is directed through a plenum beneath the conveyor belt and therefrom, through the yarn.

However, upon the increase of yarn speeds through the heat-set chamber and the use of continuous dye systems for low wet pick up, it has been found that for reasons not understood by the equipment manufacturer or by the thousands of users of such equipment, dye streaking can occur which has become evident only after the carpet product has been produced. This has resulted in excessive seconds and the loss of a great deal of money for the carpet industry. It was suspected that this problem was related to the stopping of the running of the yarn through the heat-set chamber due to doffing or ends down and furthermore, that the problem might be associated with a temperature gradient in the heat-set chamber which normally did not affect yarn dye strike rate when the yarn is continuously run through the chamber. Upon investigation and testing, particularly of possible temperature gradients which might exist throughout the length of the heat-set chamber, it was discovered that these did in fact occur and exist. The present invention concerns an improvement which has been made to the design of the heat-set chamber which essentially eliminates temperature gradients throughout the length thereof and which has totally eliminated the dye streaking problem.

SUMMARY OF THE INVENTION

In accordance with the present invention, an improved apparatus is provided for continuously heat-setting yarn, particularly nylon filament yarn comprising an elongated sealed chamber through which a porous conveyer belt travels generally along the longitudinal axis thereof to convey a plurality of yarn filaments through the heat-set chamber. The heat-set chamber has an outer shell and within such shell an enclosed plenum chamber extends longitudinally, the plenum chamber having a plurality of spaced apertures throughout its upper surface which lies immediately beneath the conveyer belt. Steam generating means are provided within the heat-set chamber such that steam at the requisite temperature surrounds the belt and the yarn thereon and a recirculation system further recirculates steam from the exit end of the heat-set chamber to within the plenum chamber adjacent to the entrance of the heat-set chamber. In accordance with the invention, the recirculation system creates higher pressure within the plenum chamber adjacent to the entrance of the heat-set chamber, the pressure within the plenum chamber becoming progressively less as steam circulates therein toward the exit end of the heat-set chamber and is emitted from the upper surface of the plenum chamber; the arrangement being such that more heat is emitted from the plenum chamber adjacent to the entrance of the heat set chamber where newly admitted yarn has created a cool zone to offset and compensate for such zone which otherwise creates dye streaking of the yarn filaments.

DESCRIPTION OF A PREFERRED EMBODIMENT

Figure 1:
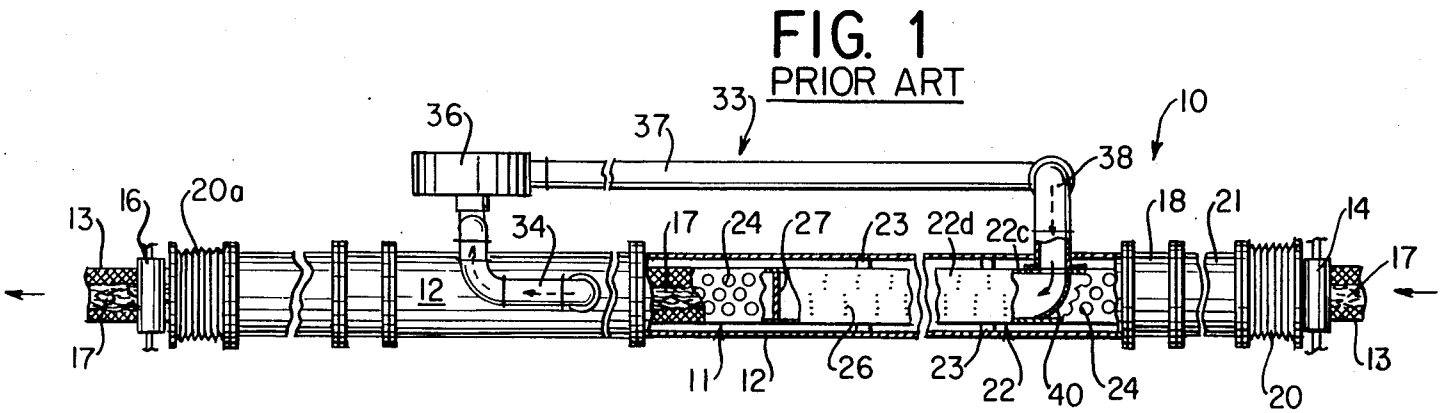
FIG. 1 PRIOR ART
FIGS. 1 & 2 are respectively plan and side views, with parts broken away, of prior art heat-set apparatus with respect to which the modification of the present information has been made.
Figure 2:
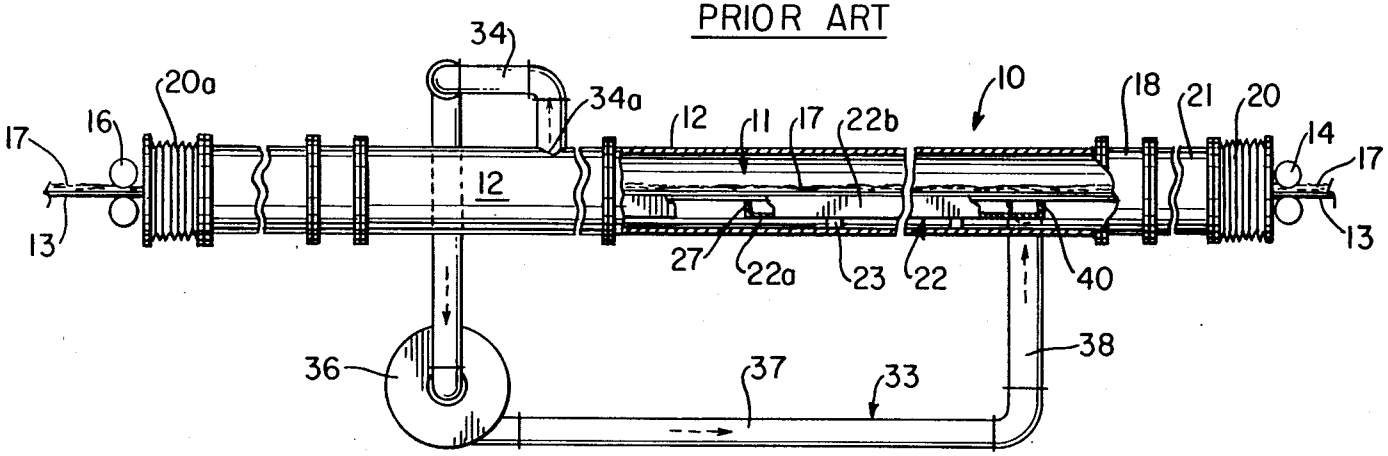
FIG. 2 PRIOR ART

Referring now to the drawing and initially to FIGS. 1 & 2 thereof, a carpet yarn heat-setting apparatus 10 commonly known as the "Superba Heat Setting Machine" has been illustrated. FIG. 1 is a plan view thereof with parts broken away and FIG. 2 is a side view with parts broken away to illustrate more particularly a heat-set chamber 11. The machine 10 consists essentially of an insulated outer tubular shell 12 approximately 18 inches in diameter, whose overall length is approximately 53 feet. A porous belt 13 driven by pairs of entrance and exit rolls 14, 16 passes through the length of the heat-set apparatus, carrying thereupon for example twenty-four strands or filaments of nylon carpet yarn 17.

As shown in FIGS. 1 & 2, the movement of belt 13 and therefore of yarn 17 is from right to left. Immediately adjacent to each of the pairs of rollers 13 & 14 are chambers **20, 20*a* which accommodate lengthwise expansion and contracting movements of the apparatus 10. Such movement may occur due to the higher temperature of the heat-setting portions of the apparatus 10 vis a vis the adjacent sections. Proceeding from right to left, immediately adjacent to chamber 20 is a cooling chamber 21 which subjects the yarn 17 to a prescribed degree of cooling, (40 degrees celsius–80 degrees celsius) to provide a uniform temperature base to the yarn prior to heat-setting. Adjacent to chamber 21 is a chamber 18 which separates the cooling chamber from the heat-set chamber 11. Internal sealing (not shown) is provided between the cooling chamber 21, the adjacent chamber 18 and the heat-set chamber 11**.

The heat-set chamber in the particular embodiment is approximately 16 feet in length and includes therein (see FIG. 5) an oblong, generally centrally located plenum chamber 22 which is essentially a closed, oblong chamber having a bottom wall **22*a* side walls 22*b* and 22*c* and a sheet metal cover 22*d*. The end of the chamber 22 nearest the entrance to heat-set chamber 11 is defined by a curved plate or baffle 40 and the opposite end of chamber 22 by a baffle plate 27. Cover 22*d* extends beyond each end of the plenum chamber as sections 22*d'* which define apertures 24 adjacent to the entrance and exit ends of chamber 11 and a plurality of smaller apertures 26 intermediate the ends of the chamber. Belt 13 passes above the upper surface of the plenum chamber 22 carrying thereupon yarn 17. Steam is generated and maintained within chamber 11 (by means not illustrated) at 270 degrees Fahrenheit, the heat-set temperature for nylon. In order to improve the distribution of heat throughout the heat-set chamber 11, a recirculation system 33 has been incorporated having a duct 34 which is connected through shell 12 at 34*a* adjacent to the exit end of the heat-set chamber 11. A fan 36 continuously withdraws the heating medium from the downstream end of chamber 11 and redirects such medium by means of ducts 37, 38 to a point adjacent to the entrance of the heat-set chamber. More specifically, the heating medium is directed to the interior of the plenum chamber 22 and therein by baffle 40 to flow through chamber 22 longitudinally toward the baffle 27 at the exit end of the plenum chamber. Recirculated steam thus migrates through apertures 26 upwardly through belt 13 and the yarn 17. Baffles 27 and 40 define the ends of the plenum chamber through which steam is recirculated. Steam directly generated within chamber 11 will rise through large apertures 24 in sections 22*d'*, to heat-set yarn 17 at the respective ends of chamber 11**.

The apparatus of FIGS. 1 & 2 has more or less become an industry standard for heat-setting yarns for the carpet industry and has become identified as "The Superba Heat-Setting Machine". Literally thousands of such machines are currently in use for heat-setting nylon filament yarn. However, as mentioned previously, increased production speeds in the heat-setting of yarns and the requirements of low wet pick up dye systems have caused dye streaking to occur which, it was suspected might have been caused by uneven heat setting of yarn by the "Superba" Machine. Since it was known that differences in heat-setting temperatures could produce variations in strike rates during the dyeing process, an investigation was made to determine temperature gradients might exist within the heat-set chamber of the apparatus described, particularly when the apparatus has been stopped due to doffing and ends down. Graphic illustrations of tests made during this investigation have been shown in FIGS. 6–9.

Figure 6:
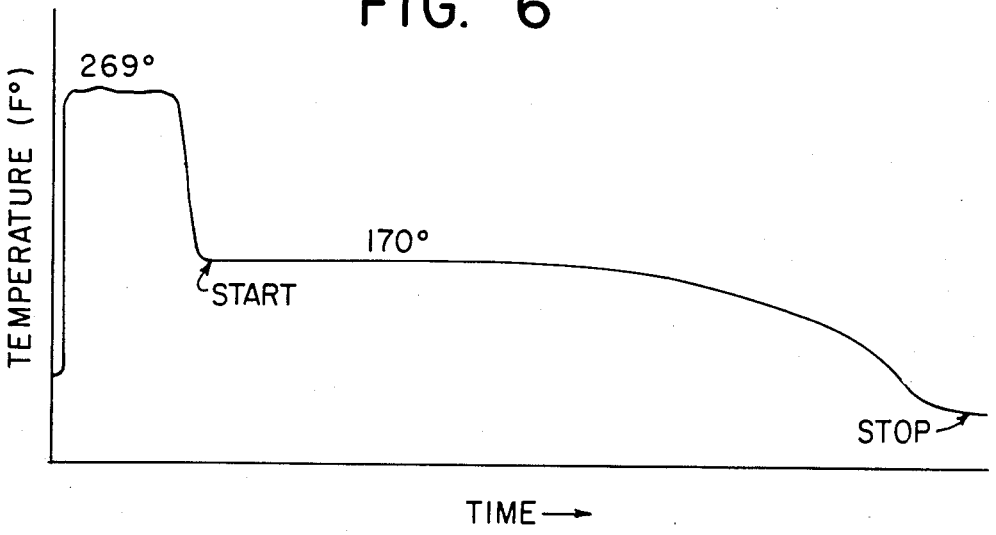
FIGS. 6–9 illustrate graphically the results of temperature measurements within the heat-set chamber at different positions length-wise therein when the running of carpet yarn through the chamber was stopped for a period of time.

FIG. 6 illustrates a condition wherein the heat-set machine has been stopped for a period of 5½ minutes after yarn has been running. Temperature has been measured at a position just prior to entrance of the yarn into the heat-set chamber. The temperature gradient at this point is shown to rise gradually with time from approximately 92 degrees Fahrenheit to 176 degrees Fahrenheit. Thereafter as the graph indicates the yarn was at a maximum temperature of 176 degrees Fahrenheit for about three minutes. Had the yarn been continuously running, the yarn at this location would have been subjected to a temperature of no more than 95 degrees.

Figure 7:
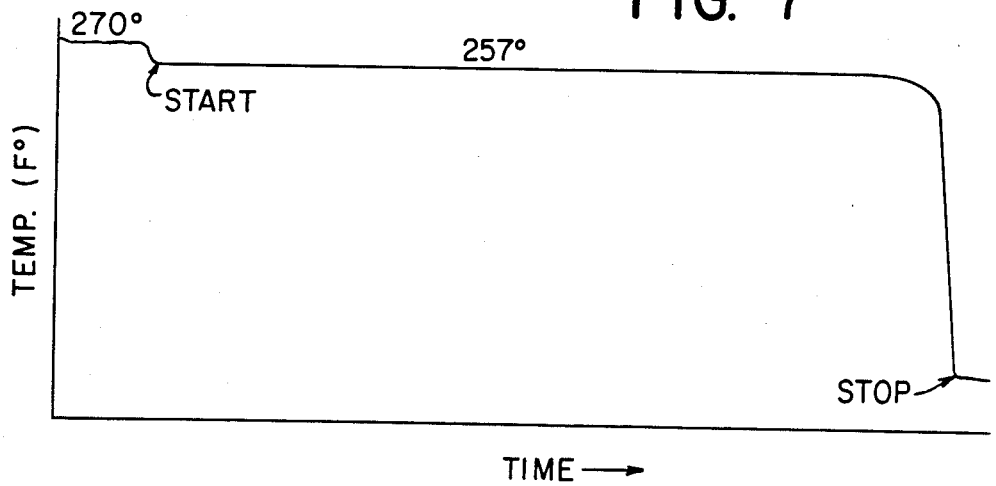

FIG. 7 illustrates the temperature to which the yarn was subjected for 3½ minutes at a location approximately 5½ inches inside the heat-set chamber from the entrance thereto. The temperature recorded was 257 degrees Fahrenheit over this period of time which is about 13 degrees less than the normal heat set tempertaure used to heat set the fiber by run.

Figure 8:
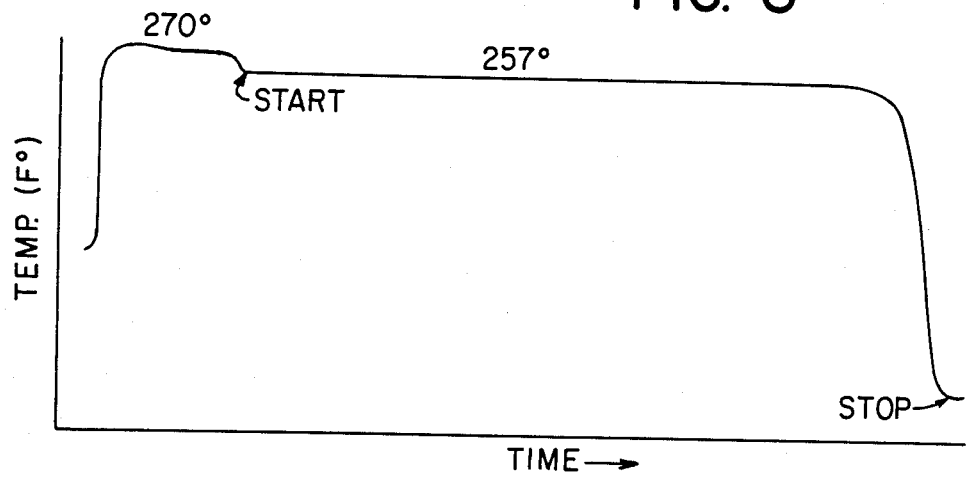

FIG. 8 illustrates the temperature which was sensed for a period of 2 minutes of stop the approximately 17 inches inside the heat-set chamber which was a location immediately upstream of the recirculation duct baffle 40. Again the temperature sensed was 257 degrees.

Figure 9:
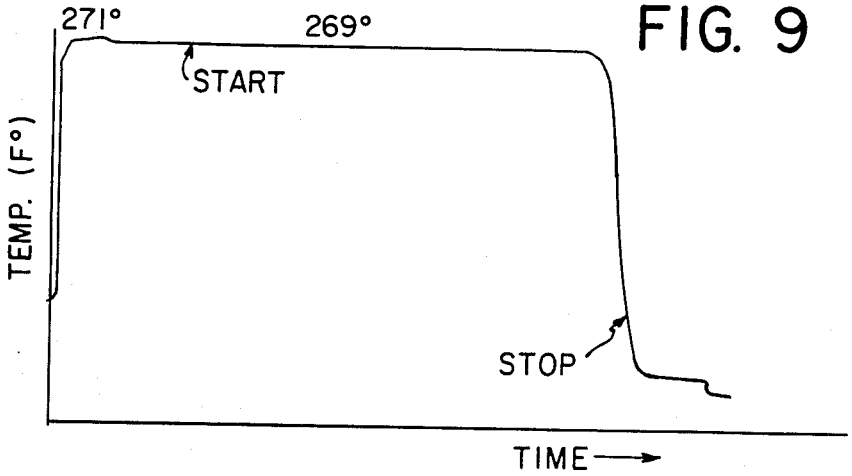

Finally, FIG. 9 shows the temperature which was sensed during a two minute stoppage of the yarn at a location 24 inches into the heat-set chamber, that is 7 inches downstream of the postion of the temperature sensing element of FIG. 8. The temperature sensed was 269 degrees or 1 degree less than the optimum 270 degrees for uniform heat setting.

An analysis of the foregoing temperature measurements led to the surprising conclusion that notwithstanding the fact that steam was being constantly generated at 270 degrees Fahrenheit throughout the heat-set chamber 11 and constantly recirculated therein, a cool zone existed from the entrance to the heat-set chamber, extending at least seventeen inches therein which was 12–13 degrees lower than the normal heat-set temperature throughout the remainder of the chamber. Furthermore, it was conjectured that this lower temperature gradient had resulted in a permanent dye strike effect upon the yarn which occurred when the machine was stopped but not while it was running.

Figure 3:
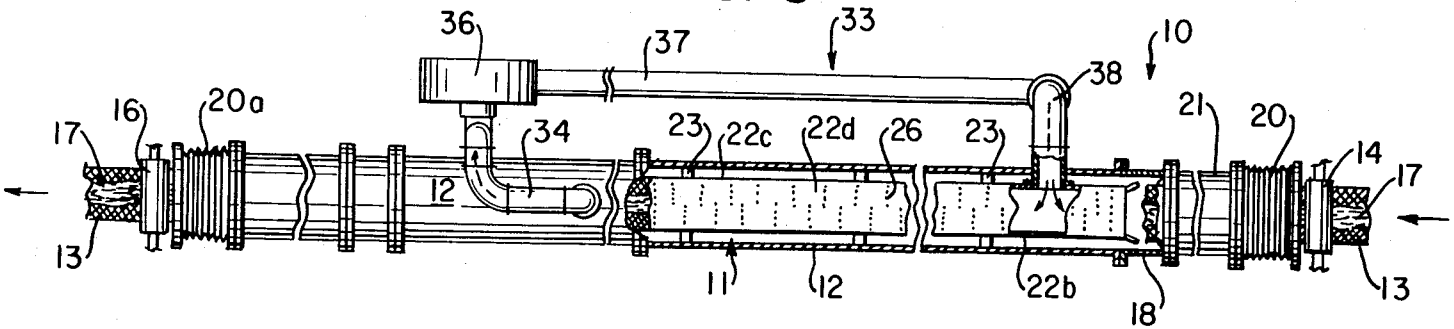
FIGS. 3 & 4 are respectively plan and side views with parts broken away of heat-set apparatus which has been modified to eliminate temperature gradients throughout the length of the heat-set chamber thereof.
Figure 4:
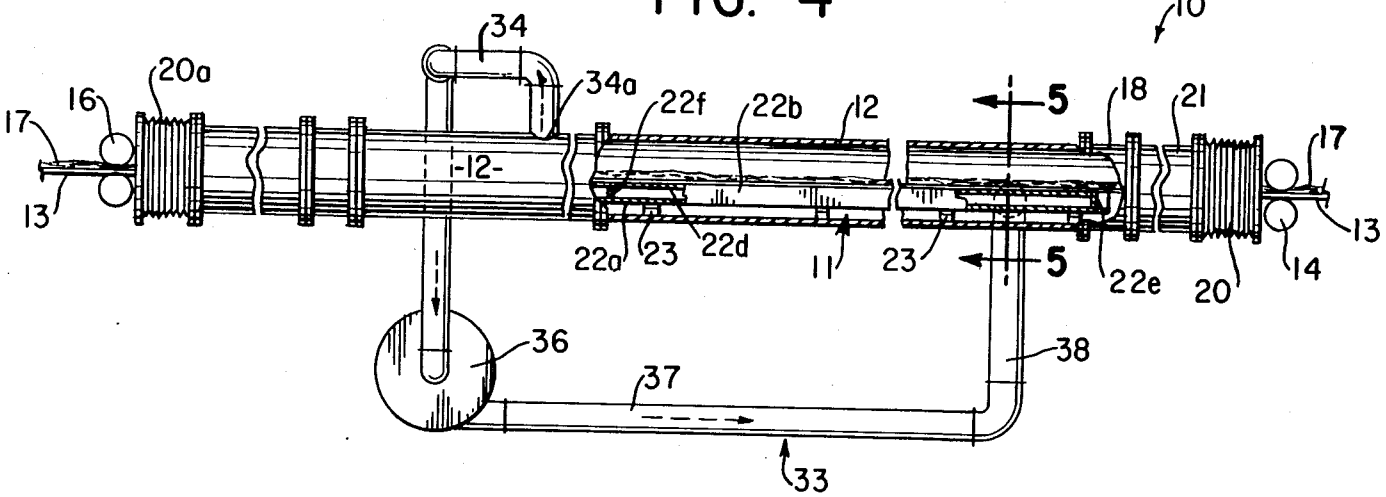
Figure 5:
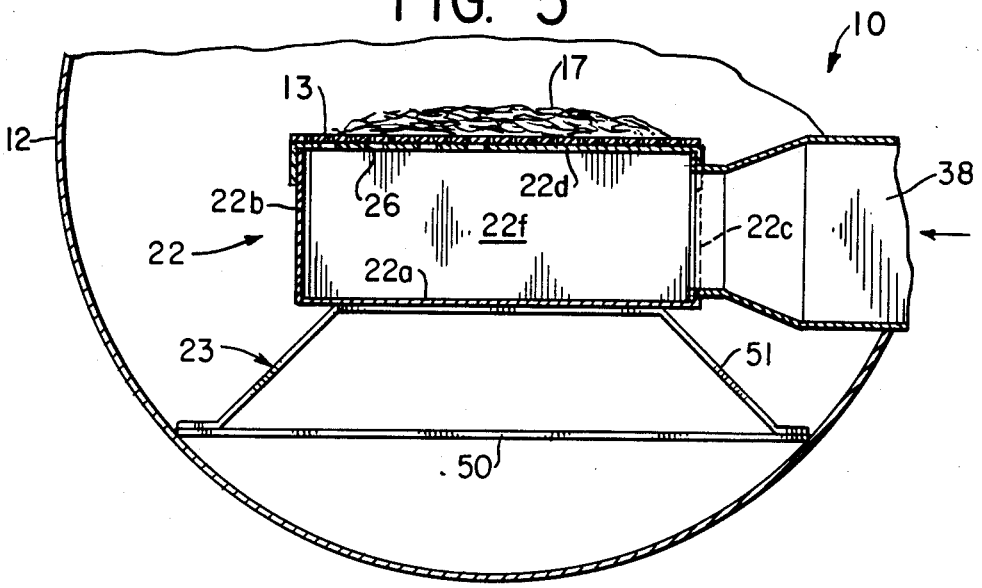
FIG. 5 is a expanded end view at the heat-set chamber in the direction of arrows 5—5 of FIG. 4.

Acting upon the conclusions from this data, certain modifications were made to the heat-setting apparatus which shall now be described with reference to FIGS. 3–5. For simplicity, the same reference numerals have been used to indicate the same or similar parts. Accordingly, it will be observed from FIGS. 3 & 4 that the following parts were changed or modified. Firstly, baffles 40 and 27 were eliminated. Secondly, the cover or the upper wall 22*d* of the plenum chamber 22 was modified to eliminate the larger apertures 24 at each end substituting therefore smaller diameter apertures 26. The plenum chamber was extended lengthwise throughout chamber 11 and the ends of the plenum chamber 22 were sealed by end walls 22*e* and 22*f*, which together with side, bottom and upper walls 22*a*–22*d* form an elongated oblong chamber which is sealed except for apertures 26 in the upper wall 22*d*. Chamber 22 is supported within shell 12 upon a series of longitudinally spaced supports 23 each comprising a plate 50 and an inverted channel support member 51. This new construction provided the flexibility needed to compensate for the cool zone found adjacent to the entrance to chamber 11. Since the forced draft pressure within the plenum chamber 22 is greater immediately adjacent to its connection through duct 38 into the plenum chamber, the modification made by this invention automatically compensates for the greater coolness of yarn as it first enters the heat-set chamber and its gradual absorption of heat after it has progressed linearly through the chamber.

Thus, as subsequent testing has shown, dye streaking caused by stopping the disclosed heat-set apparatus has been cured. The present invention very simply and effectively controls the recirculation system to produce a heat-set chamber with no temperature gradients therein notwithstanding that the yarn entering the heat-set chamber has a cooling effect upon the zone or area adjacent to the entrance to the heat-set chamber. The improvement of the present invention has taken the existing recirculating system and with a very simple modification has compensated for an apparently unavoidable cool zone adjacent to the entrance which otherwise causes unequal annealing of yarn filaments when the machine has been stopped.

It will be understood that the foregoing description has been of a particular embodiment within which the invention finds its application. In order to understand the scope thereof references should be made to the claims.

I claim:

1. In a Superba type apparatus for the heat setting of continuous filament synthetic yarns prior to dyeing of said yarns, and the type having an elongated processing unit having entry and exit ends, including an entry end cooling chamber, a tubular pressurized heat processing chamber of substantial length in relation to diameter and having entry and exit ends, an entry end sealing chamber located between said entry end cooling chamber and the entry end of said heat processing chamber, an exit end sealing chamber at the exit end of said heat processing chamber, the portions of said heat processing chamber located closest to the entry end of said processing unit comprising the entry and extremities of said heat processing chamber, means for providing a pressurized steam atmosphere within said heat processing chamber at a temperature effective for heat setting of said yarns, a porous conveyor means passing throughout the length of said processing unit and operative to carry yarns to be heat set through said chambers, the operation of said conveyor means being periodically interruptible, a system for forced circulation of the steam atmosphere including a plenum chamber extending lengthwise within the heat processing chamber beneath said conveyor means and provided with a top wall perforated to form discharge openings, a blower having discharge means discharging into said plenum chamber adjacent the entry end of said heat processing chamber, and blower intake means communicating within said heat processing chamber a substantial distance downstream of its entry end, the improvement characterized by (a) said plenum chamber being positioned to extend from the entry end extremities of said heat processing chamber for a substantial distance downstream therefrom, (b) the portions of said plenum chamber within said entry end extremities being in communication with the blower discharge whereby such portions of said plenum chamber are pressurized by said blower above ambient pressure within said heat processing chamber, (c) the discharge openings of said plenum chamber being distributed over its top surface commencing at the entry end extremities of said heat processing chamber and extending for a substantial distance downstream therefrom, (d) said plenum chamber and its positioning within said heat processing chamber serving to substantially eliminate any defect-producing reduced temperature gradient zone at the entry end extremities of said heat processing chamber.

2. Apparatus according to claim 1, and in which said heat processing chamber comprises a cylindrical pressure vessel adapted to confine steam at temperatures of about 270° F., said system for forced circulation is principally located externally of said pressure vessel, and said blower discharge means communicating with said pressure vessel a short distance downstream of the entry end extremities of said pressure vessel, further characterized by said plenum chamber extending upstream from said blower discharge means to the entry end extremities of said heat processing chamber.

3. Apparatus according to claim 2, further characterized by (a) said blower discharge means communicating with said plenum chamber at a location spaced downstream from the entry and extremities of said heat processing chamber, and (b) said plenum chamber being open to said discharge means in upstream and downstream directions therefrom.

* * * * *